US007005194B2

(12) United States Patent
Wada et al.

(10) Patent No.: US 7,005,194 B2
(45) Date of Patent: Feb. 28, 2006

(54) ALUMINUM ALLOY MEMBER SUPERIOR IN CORROSION RESISTANCE AND PLASMA RESISTANCE

(75) Inventors: Koji Wada, Kobe (JP); Jun Hisamoto, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/761,205

(22) Filed: Jan. 22, 2004

(65) Prior Publication Data

US 2004/0151926 A1 Aug. 5, 2004

(30) Foreign Application Priority Data

Jan. 23, 2003 (JP) ..... 2003-014837

(51) Int. Cl.
*B32B 3/26* (2006.01)

(52) U.S. Cl. ..... 428/472.2; 428/701; 428/702; 428/699; 428/469; 428/446; 428/650; 428/640; 428/304.4

(58) Field of Classification Search ..... 428/304.4, 428/701–702, 699, 469, 446, 472.2, 650, 428/640
See application file for complete search history.

(56) References Cited

U.S. PATENT DOCUMENTS

| | | | |
|---|---|---|---|
| 5,069,938 | A | 12/1991 | Lorimer et al. |
| 5,494,713 | A | 2/1996 | Ootuki |
| 6,027,629 | A | 2/2000 | Hisamoto et al. |
| 6,066,392 | A | 5/2000 | Hisamoto et al. |
| 6,444,304 | B1 | 9/2002 | Hisamoto et al. |
| 6,686,053 | B1 | 2/2004 | Wada et al. |
| 2003/0035970 | A1 | 2/2003 | Wada et al. |

FOREIGN PATENT DOCUMENTS

| | | |
|---|---|---|
| EP | 0 648 866 | 4/1995 |
| JP | 3-72098 | 3/1991 |
| JP | 5-53870 | 8/1993 |
| JP | 11-140690 | 5/1999 |
| JP | 11-229185 | 8/1999 |
| JP | 2000-064092 | * 2/2000 |
| TW | 343238 | 10/1998 |

OTHER PUBLICATIONS

Translation of JP-2000-064092.*

* cited by examiner

*Primary Examiner*—Ling Xu
(74) *Attorney, Agent, or Firm*—Oblon, Spivak, McClelland, Maier & Neustadt, P.C.

(57) ABSTRACT

An aluminum or aluminum alloy member superior in liquid and gaseous corrosion resistance and plasma resistance, which has an anodized film formed thereon which is composed of a porous layer and a non-porous barrier layer whose structure is at least partly boehmite or pseudo-boehmite. Said anodized film is characterized by that the film dissolving rate measured by the test for immersion in a mixture of phosphoric acid and chromic acid (conforming to JIS H8683-2) is less than 120 mg/dm$^2$/15 min, the ratio of area in which corrosion occurs after standing for 2 hours in an atmosphere of argon containing 5% chlorine (at 300° C.) is less than 15%, and the hardness (Hv) of the film is no lower than 420.

4 Claims, 2 Drawing Sheets

ALUMINUM ALLOY MEMBER SUPERIOR IN CORROSION RESISTANCE AND PLASMA RESISTANCE

BACKGROUND OF THE INVENTION

1. Field of the Invention

The present invention relates to an improvement in liquid and gaseous corrosion resistance and plasma resistance, which is made to the vacuum chamber and its parts formed from anodized aluminum alloy for dry etching apparatus, CVD apparatus, PVD apparatus, ion implantation apparatus, sputtering apparatus, etc. which are used to fabricate semiconductor and liquid crystal devices.

2. Description of the Related Art

The vacuum chamber for CVD apparatus, PVD apparatus, dry etching apparatus, etc. is required to have resistance to corrosion by corrosive gas (referred to as gaseous corrosion resistance hereinafter) because it is exposed to corrosive gases introduced thereinto, such as reaction gas, etching gas, and cleaning gas, which contain halogens like Cl, F, and Br. Moreover, the vacuum chamber is also required to have resistance to plasma (referred to as plasma resistance hereinafter) because it is often exposed to halogen-based plasma, which is generated therein, in addition to corrosive gases. The vacuum chamber adopted recently in the field of this application is one which is made of aluminum or aluminum alloy which is light in weight and superior in thermal conductivity.

Unfortunately, aluminum or aluminum alloy does not have satisfactory corrosive gas resistance and plasma resistance. So, there have been proposed several techniques for surface modification to improve such characteristic properties.

According to one of the proposed techniques, improvement in corrosive gas resistance and plasma resistance is achieved by forming an anodized film (0.5–20 $\mu$m thick) and subsequently heat-drying it at 100–150° C. in a vacuum, thereby evaporating and removing moisture adsorbed thereto. (See Japanese Patent Publication No. 53870/1993.) Another proposed technique involves anodization of aluminum alloy containing 0.05–4.0% of copper in an electrolyte of oxalic acid, said anodization being continued with a decreased voltage. (See Japanese Patent Laid-open No. 72098/1991.)

These techniques disclosed so far give aluminum alloy suitable for vacuum chamber components superior in gaseous corrosion resistance and plasma resistance. However, such vacuum chamber components are still subject to corrosion at the time of maintenance by wiping or washing with water, because water reacts with halogen compounds sticking to the surface of the aluminum alloy, thereby forming an acidic solution, which corrodes the anodized film. In other words, they are insufficient in resistance to acidic solution (referred to as liquid corrosion resistance hereinafter.) In addition, CVD apparatus, PVD apparatus, dry etching apparatus, etc. have some members which hold semiconductor wafers or LC glass substrates and remain in the apparatus while wafers or substrates are being washed. Such members are subject to corrosion because surface modification by conventional technologies does not protect the anodized film from corrosion by acidic solution used for washing. Corrosion on the vacuum chamber components of aluminum alloy used for fabrication of semiconductor and liquid crystal devices results in local change in their electrical properties, which deteriorates uniform processing. Thus, conventional vacuum chamber components are not suitable for the application area in which stringent electrical properties are required.

Several techniques for solution to this problem have been proposed. The first one is by treating the anodized film with fluorine. (See U.S. Pat. No. 5,069,938.) The second one is by filling pores in the anodized film with a metal salt. (See EP application No. 0648866.) The third one is by covering the anodized film with a silicon film. (See U.S. Pat. No. 5,494,713.) These techniques improve liquid corrosion resistance to some extent but do not sufficiently improve gaseous corrosion resistance and plasma resistance. Therefore, they find only limited use. Moreover, they are complicated and hence expensive and unacceptable to general use. The recent technical advance requires aluminum alloy members with improved corrosion resistance.

OBJECT AND SUMMARY OF THE INVENTION

The present invention was completed in view of the problems involved in the above-mentioned conventional technology. It is an object of the present invention to provide an aluminum alloy member superior in liquid corrosion resistance, gaseous corrosion resistance, and plasma resistance.

The present invention to tackle the above-mentioned problem is directed to an aluminum or aluminum alloy material having an anodized film formed thereon which is composed of a porous layer and a non-porous barrier layer whose structure is at least partly boehmite or pseudo-boehmite, said anodized film being characterized by that the film dissolving rate measured by the test for immersion in phosphoric acid-chromic acid (conforming to JIS H8683-2) is less than 120 mg/dm$^2$/15 min, the ratio of area in which corrosion occurs after standing for 2 hours in an atmosphere of argon containing 5% chlorine (at 300° C.) is less than 15%, and the hardness (Hv) of the film is no lower than 420.

The aluminum alloy mentioned above should preferably contain 2.0–3.0 mass % of Mg, less than 0.3 mass % of Si, and less than 0.1 mass % of Cu.

According to the present invention, the aluminum alloy is suitable for use as vacuum chamber members.

The present invention constructed as mentioned above provides an anodized film superior in corrosion resistance and plasma resistance, which is applied to aluminum alloy members for vacuum chambers which are superior in gaseous corrosion resistance, plasma resistance, and liquid corrosion resistance.

DESCRIPTION OF THE PREFERRED EMBODIMENTS

As mentioned above, aluminum alloy members with anodic treatment are not satisfactory in liquid corrosion resistance (effect of preventing corrosive solutions from penetrating into the barrier layer), gaseous corrosion resistance (effect of preventing corrosive gases from penetrating into the barrier layer), and plasma resistance (resistance of anodized surface to plasma). Therefore, the present inventors carried out an extensive study to improve these characteristic properties. As the result, it was found that the anodized film improves in plasma resistance while keeping good resistance to corrosion by corrosive solutions and corrosive gases if it has a barrier layer which is composed at least partly of boehmite or pseudo-boehmite and it has an adequately controlled hardness and an adequately controlled degree of conversion into boehmite. The anodized film as specified above prevents corrosion solutions and corrosive gases from penetrating into it and reaching the aluminum substrate. This finding led to the present invention. (In what follows, the term "(pseudo)boehmite" may be used to denote both boehmite and pseudo-boehmite, and the term "corrosion resistance" may be used to denote both of liquid corrosion resistance and gaseous corrosion resistance.)

Figure 1:
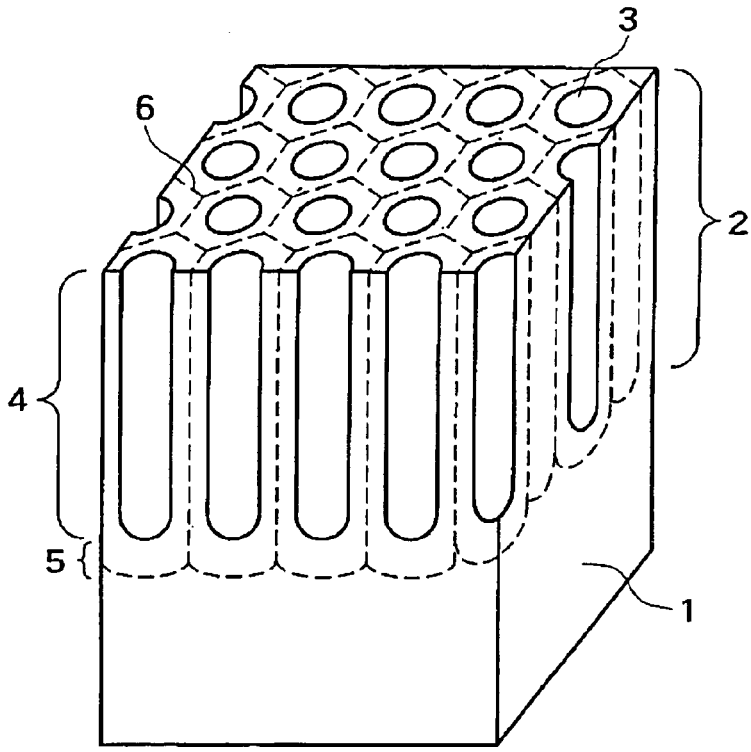
FIG. 1 is a schematic sectional view showing the structure of the anodized film.

FIG. 1 is a schematic sectional view showing the make-up of the anodized film formed on the surface of the aluminum alloy member by anodic treatment. In this figure, there are indicated an aluminum substrate at 1, an anodized film at 2, pores at 3, a porous layer at 4 (in which pores 3 are formed), a barrier layer at 5 (which is a non-porous layer existing between the porous layer 4 and the aluminum substrate 1), and cells at 6.

The anodized film illustrated in FIG. 1, which consists of the porous layer 4 (which has a large number of pores opening at the surface of the film) and the non-porous barrier layer 5, exhibits much better corrosion resistance if the structure of the barrier layer 5 is at least partly converted into (pseudo)boehmite, as compared with conventional barrier layers of the same thickness which are not converted into (pseudo)boehmite.

The improved corrosion resistance is significant particularly if conversion into (pseudo)boehmite is so carried out as to meet the following requirements.

(1) The anodized film dissolves in a mixture of phosphoric acid and chromic acid (conforming to JIS H8683-2) only at a rate less than 120 $mg/dm^2/15$ min.

(2) The anodized film suffers corrosion only in its surface area less than 15% after standing for 2 hours in an atmosphere of argon containing 5% chlorine (at 300° C.).

(3) The anodized film has a hardness (Hv) no lower than 420.

The anodized film meeting the above-mentioned requirements (1) and (2) prevents corrosive liquids and gases from infiltrating into it and reacting with the aluminum substrate. Incidentally, as the barrier layer changes into (pseudo) boehmite, the porous layer near the barrier layer also changes into (pseudo)boehmite. This renders the surface of the anodized film and the pore inner walls of the porous layer more resistant to corrosive liquids and gases. The anodized film meeting the above-mentioned requirement (3) exhibits good plasma resistance.

It follows, therefore, that aluminum alloy members will exhibit good corrosion resistance and plasma resistance if they have an anodized film meeting the above-mentioned requirements.

According to the present invention, the anodized film superior in liquid corrosion resistance is characterized by that it has a barrier layer whose structure is at least partly converted into (pseudo)boehmite and it merely dissolves in a mixture of phosphoric acid and chromic acid at a rate less than 120 $mg/dm^2/15$ min, preferably less than 70 $mg/dm^2/15$ min, and most desirably less than 20 $mg/dm^2/15$ min (when measured by the immersion test conforming to JIS H8683-2 1999). Incidentally, the anodized film will not exhibit satisfactory corrosion and plasma resistance if the rate of dissolution is greater than specified above even though its barrier layer is converted into (pseudo)boehmite, or if its barrier layer is not converted into (pseudo)boehmite even though the rate of dissolution is lower than specified above.

Meanwhile, conversion into (pseudo)boehmite can be achieved by hydration mentioned later. However, hydration expands the anodized film and even brings about cracking if conversion into (pseudo)boehmite proceeds excessively. Cracks in the anodized film permit infiltration of corrosive liquids and gases, which offsets the high corrosion resistance achieved by conversion of the barrier layer into (pseudo) boehmite. Moreover, corrosive liquids and gases infiltrate not only through cracks in the film but also through defects (such as pitting) resulting from crystallization in the aluminum substrate or from inadequate anodic treatment. Consequently, the anodized film according to the present invention should pass the above-mentioned test for immersion in a mixture of phosphoric acid and chromic acid and also should be free of film defects such as cracks.

Unfortunately, the phosphoric acid-chromic acid immersion test mentioned above does not reveal the presence of cracks and defects in the anodized film. And, it is difficult to detect local cracks and defects by observation under an optical or electron microscope. In order to eliminate this difficulty, the present inventors investigated relations between corrosion resistance and corroded area, which were observed after samples had been placed in an atmosphere of argon containing 5% chlorine at 300° C. As the result, it was found that the anodized film keeps good corrosion resistance if its corroded area is less than 15%, preferably less than 10%, of its total area. This means that the anodized film exhibits good corrosion resistance and has no defects such as cracks, if its barrier layer is at least partly converted into (pseudo)boehmite to such an extent that it passes the acid immersion test and gas corrosion test mentioned above.

The term "boehmite" and "pseudo-boehmite" as used in the present invention denotes aluminum hydroxide represented by the general formula of $Al_2O_3.nH_2O$, where n is 1 to 1.9. Whether or not the barrier layer is in the form of (pseudo)boehmite can be known from analyses by X-ray diffraction method, X-ray photoelectron spectroscopy (XPS), infrared spectroscopy (FT-IR), SEM, or the like. One method of such analyses consists of observing through an SEM the cross section of the anodized film of the aluminum alloy member, thereby specifying how far the barrier layer is from the aluminum substrate (or specifying the thickness of the barrier layer), and performing X-ray diffraction and X-ray photoelectron spectroscopy (XPS) in the direction of thickness (or depth), thereby measuring the X-ray diffraction peak intensity of Al—O, Al—OH, and Al—O—OH constituting the anodized film, which permits identification and quantitative determination. The results of analyses tell the presence of (pseudo)boehmite in the barrier layer. This method of analyses permits one to know whether or not the barrier layer is at least partly converted into (pseudo) boehmite.

The aluminum alloy member according to the present invention is required to have a high degree of plasma resistance if it is to be applied to vacuum chambers for dry etching apparatus, CVD apparatus, PVD apparatus, ion implantation apparatus, sputtering apparatus, etc. which are used for fabrication of semiconductor and liquid crystal devices. The anodized film is subject to damage (such as film scraping) by plasma having a large amount of physical energy. Plasma tends to concentrate at the edges of pores on the surface of the anodized film.

The results of the present inventors' researches revealed that while the barrier layer is being at least partly converted into (pseudo)boehmite as mentioned above, the surface of the anodized film is also converted into (pseudo)boehmite, with improvement in plasma resistance. This phenomenon is not yet fully elucidated; however, it is assumed that conversion into (pseudo)boehmite increases the bonding strength of atoms constituting the film, making the film harder and denser, which leads to improved plasma resistance. For the anodized film to have sufficient plasma resistance, it should have a hardness (Hv) higher than 420, preferably higher than 450, more desirably higher than 470.

As mentioned above, the aluminum alloy member according to the present invention exhibits good corrosion resistance and good plasma resistance if its surface (anodized film) is adequately converted into (pseudo)boehmite and adequately modified to impart a proper hardness.

In what follows, the present invention will be described in more detail with reference to a typical method of production, which is not intended to restrict the scope of the present invention but may be modified within an extent not harmful to the effect of the present invention.

In the present invention, there are no specific restrictions on aluminum or aluminum alloy constituting the substrate. An adequate aluminum substrate should be selected from the standpoint of mechanical strength, thermal conductivity, electrical conductivity, etc. which are required of the material for vacuum chambers. Moreover, the aluminum substrate should have an adequate composition (governing the amount and size of crystallized materials) which gives a hard anodized film exempt from cracking.

The aluminum substrate should contain an adequately controlled amount of alloy components (especially Si, Cu, and Mg) because it crystallizes out excessive alloy components. A desirable aluminum substrate is that of Al—Mg alloy containing 2.0–3.0% of Mg, less than 0.3% of Si, and less than 0.1% of Cu. An adequately controlled content of alloy components reduces the amount and size of the crystals which separate out. The remainder of the aluminum alloy mentioned above should substantially be aluminum; however, it may contain inevitable impurities such as Cr, Zn, and Ti. The content of these inevitable impurities should be as small as possible, preferably no more than 0.1% in total. Excessive impurities release themselves from the film surface during operation, thereby causing contamination to objects being treated (such as semiconductor wafers).

It is assumed that after the above-mentioned Al—Mg alloy has undergone anodic treatment, Mg reduces difference in thermal expansion among cells in the anodized film, although this mechanism is not yet fully elucidated. For the aluminum alloy to fully produce its effect, the content of Mg should preferably be 2.0 to 3.0%. Excessive Mg makes the anodized film poor in hardness.

Si combines with Mg to form $Mg_2Si$ or separates out in the film to form a silicon deposit phase (mentioned later). $Mg_2Si$ prevents Mg from producing the effect of reducing difference in thermal expansion among cells. The content of Si should be less than 0.3%, preferably less than 0.2%.

Cu makes the anodized film to decrease in hardness, although it forms interstices around $Mg_2Si$ resulting from excessive Si. Such interstices reduce difference in thermal expansion among cells in the anodized film. An adequate Cu content to give a sufficient film hardness should be less than 0.1%, preferably less than 0.06%.

The aluminum alloy in the present invention may be incorporated with some alloying elements for its desired characteristics to an extent not harmful to the function of the anodized film. However, such alloy elements as chromium and zinc should be avoided because they scatter out from the anodized film attacked by plasma during fabrication, thereby causing contamination to semiconductor and liquid crystal devices.

Figure 2:
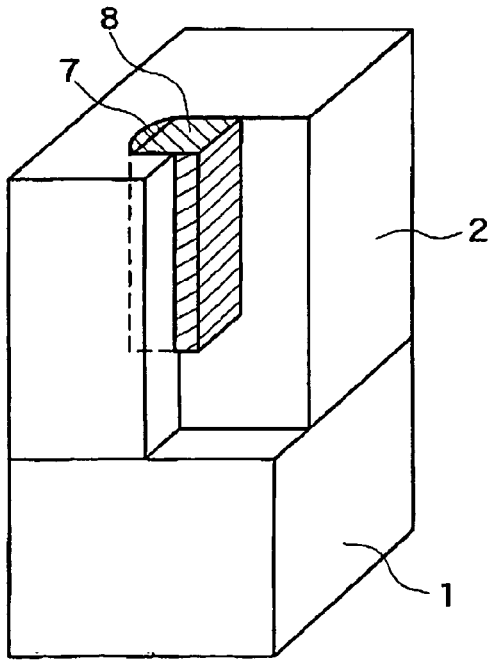
FIG. 2 is a schematic sectional view showing deposited silicon (orienting in the direction perpendicular to the surface) and voids.

The aluminum substrate may contain crystallized materials originating from alloying elements and inevitable impurities. The crystallized materials are solids remaining undissolved in the substrate aluminum matrix. For example, an excess amount of Si remains undissolved and crystallizes out in the matrix. Such crystallized materials remain in the anodized film without dissolution during anodic treatment, and their interface with the film matrix permits infiltration of corrosive liquids and gases. Thus, the anodized film is poor in corrosion resistance. In the case of an anodized film with crystallized Si as shown in FIG. 2, there is a void 7 between the crystallized Si 8 and the anodized film matrix 2. This void permits corrosive liquids to infiltrate and reach the aluminum substrate which lacks corrosion resistance. Moreover, the void starts cracking in the anodized film.

Figure 3:
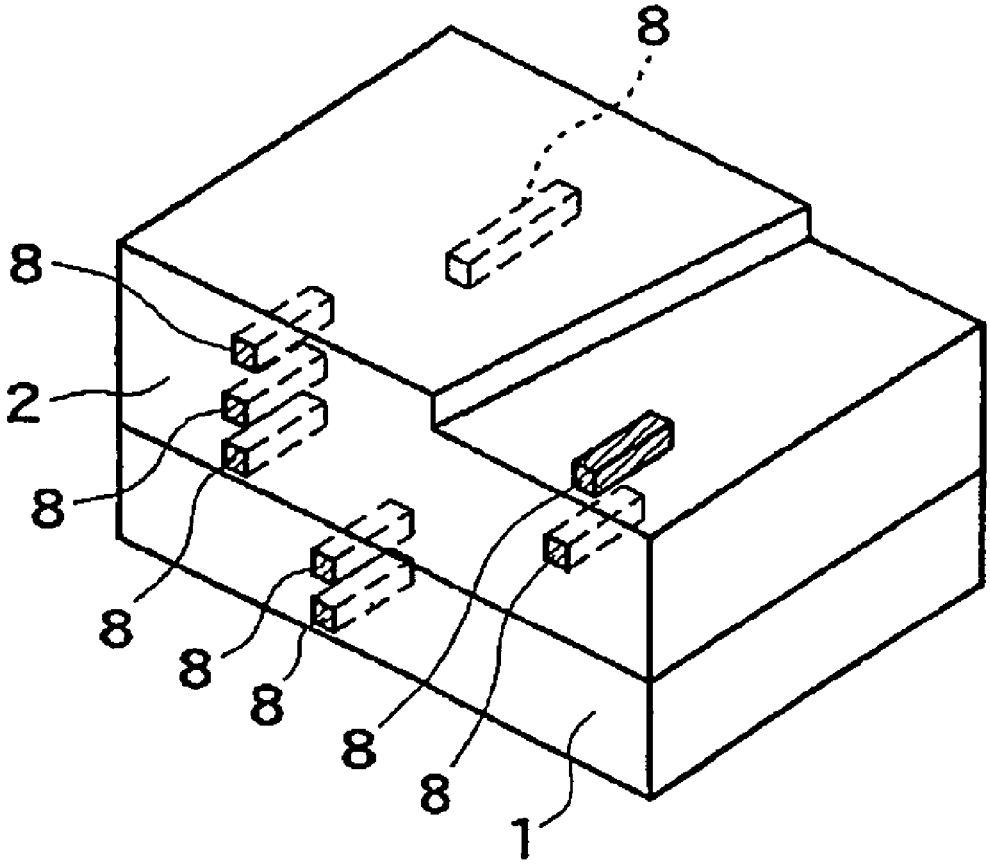
FIG. 3 is a schematic sectional view showing deposited silicon (orienting in the direction parallel to the surface).

Consequently, crystallized materials should be as few as possible for improvement in corrosion resistance and cracking resistance. Moreover, they should have as small an average particle size as possible so that they are limited in their adverse effect even though they exist in the anodized film. The small particle size reduces the volume of voids and the amount of infiltrating corrosive liquids. In addition, it is desirable that the crystallized materials in the substrate should orient in the direction parallel to its surface, as shown in FIG. 3, because they remain orienting in the same direction after anodization and hence prevent corrosive liquids from infiltrating in the depth direction (or thickness direction). This leads to improved resistance to corrosive liquids. Furthermore, the anodized film with horizontally orienting crystallized materials is less liable to cracking than the one with vertically orienting crystallized materials.

Thus, the aluminum substrate should preferably contain fine crystallized materials orienting parallel to the surface thereof. Although such crystallized materials may remain in the anodized film formed thereon afterward, they still retain their original fine size and original orienting direction. Consequently, they are adequately separated from one another in the vertical direction in which corrosive liquids infiltrate. This structure is effective in blocking corrosive liquids and gases from infiltrating through the interface between the aluminum matrix and the crystallized materials.

For crystallized particles to produce the above-mentioned effect, they should have a particle size such that the shorter axis perpendicular to the longer axis is on average no longer than 10 $\mu$m, preferably no longer than 6 $\mu$m, and most desirably no longer than 3 $\mu$m. In the case of deposited particles, it should preferably be no longer than 2 $\mu$m and most desirably be no longer than 1 $\mu$m. The above-mentioned particle size is an average one; the maximum particle size should be no larger than 15 $\mu$m, preferably no larger than 10 $\mu$m. Otherwise, the resulting anodized film may not have satisfactory corrosive liquid resistance or cracking resistance.

Incidentally, the average particle diameter is defined as the quotient of the sum of the maximum diameters of individual particles divided by the total number of particles.

The particles are observed on the cross section of the aluminum substrate and the anodized film formed thereon with the help of an optical microscope (said cross section being perpendicular to the surface of the aluminum member).

The anodized film may be subject to local deterioration due to crystallized or deposited particles which are unevenly distributed. For avoidance of this trouble, such particles should desirably be uniformly distributed in the anodized film. This object is achieved only if such particles are uniformly distributed in the aluminum substrate before anodic treatment. Incidentally, there are no specific restrictions on the method for fine dispersion and uniform distribution of such particles in the aluminum substrate. The object may be achieved by controlling the casting rate when the aluminum substrate is produced. In other words, the particle diameters can be reduced as the cooling rate in casting is maximized. To be concrete, the cooling rate in casting should be no smaller than 1° C./s, preferably no smaller than 10° C./s. In addition, the final heat treatment (such as T4 and T6) is able to control the shape and distribution of deposited particles as desired. In other words, heat treatment is carried out such that the melting temperature is as high as possible (close to the solid phase high temperature) so that supersaturated solid solution is formed, and this heat treatment is followed by aging in two or three stages. Heat treatment under adequate conditions that follows casting makes deposited particles small and ensures their uniform distribution in the substrate matrix. In addition, crystallized particles and deposited particles readily orient in the direction of hot extrusion or hot rolling that follows casting. Thus it is possible to make particles orient in the parallel direction as mentioned above if the direction of extrusion or rolling is adequately controlled.

The present invention features the state of the anodized film but does not specifically restrict the condition under which the anodized film is formed. The anodized film should be free of any defects, such as cracks, voids, and peeling from the aluminum substrate. Otherwise, it does not exhibit satisfactory corrosion resistance because such defects permit infiltration of corrosive liquids and gases. In addition, such defects make the anodized film poor in surface smoothness and cause plasma to concentrate thereon, which leads to low plasma resistance. Moreover, such defects permit infiltration of corrosive liquids and gases, which also leads to unsatisfactory corrosion resistance. The above-mentioned anodic treatment which is performed on the aluminum substrate easily provides the anodized film which is free of defects, such as cracking, and has a high film hardness, as featured in the present invention.

The anodic treatment is carried out by using an electrolytic solution which is exemplified by an inorganic acid (such as sulfuric acid, phosphoric acid, chromic acid, and boric acid) or an organic acid (such as formic acid and oxalic acid). A desirable electrolytic solution is one which has a low dissolving power for the anodized film. A solution of oxalic acid is particularly desirable because it permits easy control of anodizing conditions (such as electrolytic voltage etc.) and readily forms a very smooth anodized film. Other organic acids that can be used are malonic acid and tartaric acid, which have a small dissolving power for the anodized film. However, they do not permit the anodized film to grow at a sufficiently high rate. Therefore, malonic acid should be used in combination with oxalic acid to accelerate the film growing rate.

There are no specific restrictions on the concentrations of the electrolytic solution, which may be adequately controlled such that the electrolytic solution forms an anodized film free of defects (such as pitting) at a sufficiently high film growing rate. An electrolytic solution of oxalic acid should have a concentration higher than 2% so that it provides a sufficiently high film growing rate. However, it should have a concentration lower than 5% so as to avoid its possibility of causing pitting to the anodized film.

There are other known electrolytic solutions than mentioned above. An example of them is a solution of sulfuric acid, which yields an anodized film which is hard but subject to cracking. Therefore, anodizing with sulfuric acid needs more stringent control than anodizing with oxalic acid for the composition of the aluminum substrate, the temperature of the electrolytic solution, the voltage and duration of electrolysis, and the concentration of sulfuric acid. Another example of known electrolytic solutions is chromic acid. Chromic acid, however, causes the resulting anodized film to contain chromium which impairs the characteristic properties of semiconductor and liquid crystal devices, as mentioned above.

Anodizing with phosphoric acid is also known. However, it suffers the disadvantage of causing the resulting anodized film to contain residual phosphorus which impedes the hydration reaction, thereby presenting difficulties in conversion of the barrier layer into (pseudo)boehmite. Moreover, an electrolytic solution of boric acid does not provide any anodized film with a sufficient thickness for the necessary characteristic properties because of its low dissolving power for aluminum.

There are no specific restrictions on the bath temperature of the electrolytic solution for anodic treatment. Anodizing with an excessively low bath temperature does not provide a sufficiently high film growing rate but reduces the anodizing efficiency. Anodizing with an excessively high bath temperature dissolves the anodized film and causes defects to it. The bath temperature of oxalic acid should be no lower than 10° C., preferably no lower than 15° C., and no higher than 35° C., preferably no higher than 30° C.

There are no specific restrictions on the bath voltage for anodic treatment. The bath voltage should be adequately controlled according to the film growing rate and the concentration of the electrolytic solution. Anodizing with oxalic acid at a low bath voltage gives an anodized film having a low hardness and is low in film growing rate (and hence is poor in anodizing efficiency). By contrast, anodizing at a high bath voltage makes the resulting anodized film to dissolve, causing defects to it. The bath voltage should be no lower than 20 V, preferably no lower than 30 V, and no higher than 120 V, preferably no higher than 100 V. The duration of anodic treatment is not specifically restricted; it may be so established as to give a desired film thickness.

There are no specific restrictions on the thickness of the anodized film to be formed by the anodic treatment. The anodized film should have a sufficient thickness so that it exhibits good gaseous corrosion resistance, liquid corrosion resistance, and plasma resistance. It should be no thinner than 10 μm, preferably no thinner than 25 μm, and most desirably no thinner than 40 μm. It should also be no thicker than 120 μm, preferably no thicker than 100 μm, and most desirably no thicker than 60 μm. An excessively thick film is liable to cracking and peeling due to internal stress.

According to the present invention, the anodized film obtained by anodic treatment should undergo hydration for conversion into (pseudo)boehmite. Incidentally, since hydration changes the pore diameter, the present invention does not specifically restricts the diameter of the pores which are formed in the film surface after anodic treatment.

The barrier layer plays an important role in protecting the aluminum alloy substrate from contact with corrosive liquids and gases infiltrating into pores. Upon prolonged exposure to corrosive liquids or gases, the barrier layer gradually permits their infiltration to the aluminum substrate with time. Consequently, the barrier layer should preferably be as thick as possible. However, as the barrier layer becomes thicker, the pore diameter becomes larger, and as the pore diameter becomes larger, the barrier becomes poorer in plasma resistance. This implies that the barrier layer does not improve in corrosion resistance in proportion to its thickness because it permits corrosive liquids or gases to more readily infiltrate through pores in it.

This is the reason why the conventional anodized film does not have the balanced plasma resistance and corrosion resistance, which is required of the vacuum chamber member used for fabrication of semiconductor and liquid crystal devices.

Unlike the conventional one, the aluminum alloy member according to the present invention exhibits good resistance to corrosion by plasma as well as corrosive liquids and gases without the necessity for a thick barrier layer which inevitably leads to a large pore diameter, because it has the barrier layer whose structure is at least partly converted into (pseudo)boehmite. Incidentally, the thickness of the barrier layer is not specifically restricted; it may be adequately established according to performance required of specific uses. According to the present invention, it is not always necessary to convert the barrier layer entirely into (pseudo) boehmite. The extent of conversion into (pseudo)boehmite depends on the degree of corrosion resistance required.

"Converting the barrier layer at least partly into (pseudo) boehmite" means that the porous layer on the barrier layer is also converted into (pseudo)boehmite because hydration causes conversion into (pseudo)boehmite to proceed from the surface of the anodized film. Therefore, the anodized film according to the present invention has its surface part also converted into (pseudo)boehmite and hence it exhibits better plasma resistance than the conventional one without conversion into (pseudo)boehmite if the pore diameter is the same. In addition, the anodized film itself has improved corrosion resistance if its surface part is converted into (pseudo)boehmite.

Conversion into (pseudo)boehmite is accomplished by hydration which is performed on the anodized film (or aluminum oxide film) formed on the aluminum substrate. Hydration consists of immersing the anodized film in hot water or exposing the anodized film to steam (at 100° C. or above), thereby sealing pores. Conditions for hydration may be properly established. Since hydration brings about volume expansion that starts from the surface of the anodized film, it needs accurate control for pressure, temperature, and duration. Volume expansion near the surface shrinks pores, and shrunk pores impede steam infiltration into them. This in turn prevents the barrier layer from complete conversion into (pseudo)boehmite. Moreover, excessive expansion in the surface of the anodized film would cause cracking. Excessively short hydration does not achieve complete conversion into (pseudo)boehmite. Conversely, excessively long hydration causes cracking to the film, which adversely affects corrosive liquid resistance. Hydration under high pressure permits steam to readily reach the barrier layer; however, it also proceeds rapidly in the film surface, thereby posing the above-mentioned problem. Moreover, hydration at a high temperature promotes conversion of the anodized film into (pseudo)boehmite; however, it also proceeds rapidly in the film surface, thereby posing the above-mentioned problem. The adequate pressure and temperature for hydration with steam vary depending on the size of pores in the anodized film, the film thickness, and the duration of hydration. Hydration with steam needs precise control as mentioned above and hence presents difficulties in giving the anodized film as specified in the present invention. Therefore, hydration by immersion in hot water is recommended.

Hydration by immersion in hot water should preferably employ pure water. Pure water may be incorporated with additives according to the object of hydration; however, they may add to cost and complex the process. Additives caught in pores may impair the characteristic properties of semiconductor and liquid crystal devices. Thus it is desirable to specify the amount of substances contained in the treating solution if additives are used.

In the case of nickel acetate as an additive, its concentration in the treating solution should be less than 5 g/L, preferably less than 1 g/L. Likewise, the concentration of cobalt acetate should be less than 5 g/L, preferably less than 1 g/L. The concentration of potassium dichromate should be less than 10 g/L, preferably less than 5 g/L. The concentration of sodium carbonate should be less than 5 g/L, preferably less than 1 g/L. The concentration of sodium silicate should be less than 5 g/L, preferably less than 1 g/L. Treatment with hot water becomes shorter as the water temperature increases; in this case, however, the duration of treatment needs precise control because of its narrow latitude. Treatment takes a longer time as the water temperature decreases. A recommended water temperature is no lower than 70° C., preferably no lower than 75° C. Time required for hydration is not specifically restricted; it may be properly controlled according to the temperature and the rate of hydration. Excessively short hydration may not achieve complete conversion into (pseudo)boehmite, and excessively long hydration may cause cracking to the anodized film, which deteriorates liquid corrosion resistance and film surface hardness.

Hydration as mentioned above brings about conversion into (pseudo)boehmite in the region of the anodized film extending from the film surface to the barrier layer. Thus it adequately modifies the anodized film without causing film defects.

The present invention does not specify whether or not pores exist in the film surface after hydration. Pores may be either sealed or remain open after hydration so long as the barrier layer is at least partly converted into (pseudo) boehmite to such an extent that the anodized film exhibits the above-mentioned characteristic properties. In addition, there are no restrictions on the size (or shape) of pores in the porous layer of the anodized film; pores in the barrier layer may be larger than those in the film surface, or vice versa.

The aluminum alloy member, with its surface anodized, according to the present invention exhibits better resistance to corrosion by plasma as well as corrosive liquids and gases than the conventional one when it is used as a vacuum chamber or parts thereof for dry etching apparatus, CVD apparatus, PVD apparatus, ion implantation apparatus, sputtering apparatus, etc. which are used to fabricate semiconductor and liquid crystal devices.

The invention will be described in more detail with reference to the following examples, which are not intended to restrict the scope thereof. Various changes and modifications may be made in the invention without departing from the spirit and scope thereof.

EXAMPLES

Each sample of aluminum substrates shown in Table 1 was cut into a square specimen measuring 50 mm by 50 mm. With its surface polished by an abrasive paper (#400), the specimen was immersed in a 10% NaOH solution at 50° C. for 15 seconds (for degreasing) and then immersed in a 20% $HNO_2$ solution at room temperature for 5 minutes (for desmutting). The pretreated specimen was anodized under the conditions shown in Table 2 so that an anodized film was formed thereon. The anodic treatment was followed by hydration under the conditions shown in Table 3. The resulting test pieces were examined for corrosion resistance in the following manner.

[Anodic Treatment]

Each test piece was placed in an electrolytic bath containing 10 liters of the electrolytic solution shown in Table 2. The electrolytic solution was kept at the temperature shown in Table 2 by a thermostat. A voltage shown in Table 2 was applied between the test piece (or the aluminum substrate) and a platinum counter electrode. The voltage application was continued until an anodized film of desired thickness was formed. Finally, the test piece was rinsed.

[Hydration]

Treatment with hot water: The test piece was immersed in 2 liters of hot water for a prescribed length of period. Finally, the test piece was rinsed and dried.

Treatment with pressurized steam: The test piece was exposed to steam in an autoclave under specific conditions (pressure and temperature) for a prescribed period of time. Finally, the test piece was rinsed and dried.

[Phosphoric Acid-Chromic Acid Immersion Test]

This test was conducted as follows according to JIS H8683-2 1999. First, the specimen was immersed in nitric acid solution (500 mL/L at 18–20° C.) for 10 minutes. Then the specimen was rinsed with deionized water and dried with warm air. The specimen was weighed. Next, the specimen was immersed in 1 liter of deionized water (at 38±1° C.) containing 35 mL of phosphoric acid and 20 g of chromic anhydride, for 15 minutes. The specimen was washed in a bath and then in running water and thoroughly rinsed with deionized water and dried with warm air. The specimen was weighed again. The loss of weight per unit area was calculated and the rate of dissolution ($mg/dm^2/15$ min) was calculated from the loss of weight thus measured. The smaller is the rate of dissolution, the greater is the degree of modification of the anodized film, which has been converted into (pseudo)boehmite. The rate of dissolution of the anodized film is shown in Table 3, under the column of phosphoric acid-chromic acid immersion test, in which the unit is $mg/dm^2/15$ min.

[Chlorine Gas Corrosion Test]

First, the test piece was wiped with a soft cloth moistened with acetone. The anodized film of the test piece was partly masked with a polyimide tape (which is resistant to chlorine gas), such that an area of 20 mm by 20 mm was exposed. The test piece was placed in a silica tube (resistant to chlorine gas), which is provided with a heater and a thermocouple for temperature measurement and control. The silica tube was heated from room temperature to 145–155° C. over 20–30 minutes and then kept at 145–155° C. for 60 minutes. The silica tube was supplied with argon containing 5% (±0.2%) of chlorine at a flow rate of 130 cc/min. The silica tube was further heated to 295–305° C. over 10–15 minutes and was kept at this temperature, during which the pressure therein was adjusted to atmospheric pressure. The silica tube was continuously supplied with chlorine-containing argon for 2 hours. The silica tube was supplied with nitrogen to scavenge chlorine-containing argon over 2–3 hours before cooling to room temperature. After removal from the silica tube, the test piece was examined to calculate the ratio of corroded area to its surface area. This ratio is an index indicating the presence of cracking and other defects on the surface of the anodized film. The lower the ratio, the less the surface defects, and vice versa. Disappearance of the anodized film from the test piece was regarded as the occurrence of corrosion. The test piece assumed discoloration in the part where the anodized film had disappeared and corrosion reached the aluminum substrate. The results of the test are shown in Table 3.

[Conversion of Barrier Layer into (Pseudo)Boehmite]

The test piece was examined as follows to determine whether or not the barrier layer underwent conversion into (pseudo)boehmite. First, the cross section of the anodized film of the test piece was observed under an SEM (×2000–100000) to measure the thickness of the barrier layer. The barrier layer was quantitatively analyzed (in the depthwise direction) for Al—O, Al—OH, and Al—O—OH as constituents of the anodized film by X-ray diffraction and X-ray photoelectron spectroscopy (XPS) in combination. The results are shown in Table 3. The marks ○ and × respectively indicate that the barrier layer at least partly underwent or did not undergo conversion into (pseudo) boehmite.

[Hydrochloric Acid Immersion Test]

First, the test piece was wiped with a soft cloth moistened with acetone. The test piece was placed in an oven heated at 150° C. (The oven temperature decreased to 145° C. after the opening and closing of the oven door; however, it returned to 150° C. within about 10 minutes.) The test piece was kept at 150° C. for 1 hour in the oven. After cooling (for about 1 hour) to room temperature, the test piece was partly masked with a fluoroplastic tape (which is resistant to hydrochloric acid), such that an area of 40 mm by 40 mm was exposed. The test piece was placed in a container, with the exposed surface upward. The container was filled with 7% hydrochloric acid until the level of the hydrochloric acid was 40 mm above the test piece. Incidentally, the amount of hydrochloric acid corresponding to the depth of 40 mm was 150 cc. The test piece was allowed to stand in the hydrochloric acid at room temperature. Time required for continuous evolution of hydrogen gas to begin (after the pouring of 7% hydrochloric acid) was measured. The reaction involved in this test is represented by the following equation.

$$2Al+6HCl \rightarrow 2AlCl_3+3H_2\uparrow$$

The longer the time before evolution of hydrogen gas, the better the corrosion resistance of the test piece. The results are shown in Table 3. For the test piece to have good corrosion resistance, the time before evolution of hydrogen gas should be longer than 260 minutes, preferably longer than 280 minutes, and most desirably longer than 300 minutes.

[Measurement of Film Hardness]

The cross section of the anodized film was examined for Vickers hardness according to JIS Z2244 under the following conditions.

Load: 25 gf, rate of loading: 3 μm/s, duration of load application: 15 seconds.

[Rotary Polishing Test]

First, the test piece (measuring 50 mm by 50 mm) was wiped with a soft cloth moistened with acetone. After attachment to the header of an automatic rotary polishing machine, the test piece under a load of 3.4 kf was polished in flowing water (800 cc/min) with an emery abrasive paper (#500, 290 mm in diameter) rotating at a rate of 100 rpm. The header was positioned such that the center of the test piece was 80 mm away from the center of the abrasive paper. Duration of polishing ranged from 1 to 5 minutes depending on the film thickness and the polishing rate. Before and after polishing, the amount of polishing was calculated from the thickness at the center of the test piece which was determined by non-destructive measurement with an over-current film thickness gauge. The rate of polishing was calculated from the amount of polishing and the time spent for polishing. The anodized film on the test piece is regarded as having good plasma resistance if the amount of polishing measured as mentioned above is no more than 7 μm/min, preferably no more than 5 μm/min, and most desirably no more than 3 μm/min.

TABLE 1

| Code | Si (mass %) | Mg (mass %) | Cu (mass %) | Orientation | Particle diameter |
|---|---|---|---|---|---|
| L01 | 0.1 | 2.5 | 0.05 | Parallel | 5 |
| L02 | 0.1 | 2.5 | 0.05 | Perpendicular | 5 |
| C01 | 0.22 | 2.0 | 0.02 | Parallel | 4 |
| C02 | 0.15 | 3.0 | 0.01 | Parallel | 7 |
| C03 | 0.29 | 2.6 | 0.05 | Parallel | 6 |
| C04 | 0.18 | 2.1 | 0.09 | Parallel | 4 |
| C05 | 0.20 | 2.9 | 0.08 | Parallel | 11 |
| C06 | 0.05 | 1.8 | 0.03 | Parallel | 3 |
| C07 | 0.23 | 3.2 | 0.02 | Parallel | 9 |
| C08 | 0.31 | 2.5 | 0.06 | Parallel | 8 |
| C09 | 0.13 | 2.3 | 0.12 | Parallel | 8 |
| C10 | 1.0 | 2.0 | 1.0 | Parallel | 5 |
| C11 | 0.2 | 3.2 | 0.1 | Parallel | 8 |
| C12 | 1.0 | 2.0 | 0.08 | Parallel | 8 |

TABLE 2

| | | Anodic treatment | | | |
|---|---|---|---|---|---|
| No. | Substrate | Electrolytic solution | Bath temperature (° C.) | Bath voltage (V) | Film thickness (μm) |
| 1 | L01 | 3% oxalic acid | 16 | 60 | 50 |
| 2 | | 3% oxalic acid | 16 | 60 | 50 |
| 3 | | 3% oxalic acid | 16 | 60 | 50 |
| 4 | | 3% oxalic acid | 16 | 60 | 50 |
| 5 | | 4% oxalic acid | 25 | 70 | 15 |
| 6 | | 3% oxalic acid | 16 | 60 | 50 |
| 7 | | 3% oxalic acid | 16 | 60 | 50 |
| 8 | | 3% oxalic acid | 16 | 60 | 50 |
| 9 | | 3% oxalic acid | 16 | 60 | 50 |
| 10 | | 3% oxalic acid | 16 | 60 | 50 |
| 11 | | 3% oxalic acid | 16 | 60 | 50 |
| 12 | | 3% oxalic acid | 16 | 60 | 50 |
| 13 | | 3% oxalic acid | 16 | 60 | 50 |
| 14 | | 3% oxalic acid | 16 | 60 | 50 |
| 15 | | 3% oxalic acid | 16 | 60 | 50 |
| 16 | | 3% oxalic acid | 20 | 50 | 30 |
| 17 | | 2.5% oxalic acid | 20 | 30 | 18 |
| 18 | | 3% oxalic acid | 16 | 60 | 50 |
| 19 | | 3% oxalic acid | 16 | 60 | 50 |
| 20 | | 4.5% oxalic acid | 30 | 40 | 60 |
| 21 | | 3% oxalic acid | 16 | 60 | 50 |
| 22 | | 3% oxalic acid | 16 | 60 | 50 |
| 23 | | 4% oxalic acid + 1% | 18 | 30 | 40 |
| 24 | | sulfuric acid | | | |
| 25 | | | | | |
| 26 | | 12% malonic acid + 4% | 25 | 100 | 45 |
| 27 | | oxalic acid | | | |
| 28 | | | | | |
| 29 | | | | | |
| 30 | | | | | |
| 31 | L02 | 3% oxalic acid | 16 | 60 | 50 |
| 32 | C01 | 3% oxalic acid | 16 | 60 | 50 |
| 33 | C02 | | | | |
| 34 | C03 | | | | |
| 35 | C04 | | | | |
| 36 | C05 | | | | |
| 37 | C06 | | | | |
| 38 | C07 | | | | |
| 39 | C08 | | | | |

TABLE 2-continued

| No. | Substrate | Anodic treatment: Electrolytic solution | Bath temperature (° C.) | Bath voltage (V) | Film thickness (μm) |
|---|---|---|---|---|---|
| 40 | C09 | | | | |
| 41 | C10 | 4% oxalic acid | 18 | 30 | 40 |
| 42 | C11 | | | | |
| 43 | C12 | | | | |

TABLE 3

| No. | Hydration: Method | Temperature (° C.) | Duration (min) | Conversion of barrier layer into (pseudo) boehmite | Phosphoric acid-chromic acid immersion test | Chlorine gas corrosion resistance test (%) | Hydrochloric acid immersion test (min) | Film hardness (Hv) | Polishing test (μm/min) |
|---|---|---|---|---|---|---|---|---|---|
| 1 | Immersion in hot water | 75 | 23 | ○ | 9 | 5 | 290 | 450 | 4 |
| 2 | Immersion in hot water | 100 | 9 | ○ | 2 | 6 | 290 | 430 | 7 |
| 3 | Immersion in hot water | None | | x | 155 | <1 | <1 | 480 | 2 |
| 4 | Immersion in hot water | 100 | 24 | ○ | 1 | 25 | <1 | 390 | 10 |
| 5 | Immersion in hot water | 80 | 18 | ○ | 2 | 13 | 260 | 440 | 6 |
| 6 | Immersion in hot water | 75 | 16 | ○ | 130 | <1 | 150 | 475 | 2 |
| 7 | Immersion in hot water | 75 | 33 | ○ | 1 | 12 | 270 | 435 | 6 |
| 8 | Immersion in hot water | 100 | 8 | ○ | 18 | 4 | 280 | 445 | 5 |
| 9 | Immersion in hot water | 100 | 10 | ○ | 1 | 8 | 280 | 420 | 7 |
| 10 | Immersion in hot water | 75 | 18 | ○ | 47 | 3 | 260 | 470 | 3 |
| 11 | Immersion in hot water | 75 | 43 | ○ | 1 | 18 | 130 | 430 | 7 |
| 12 | Immersion in hot water | 100 | 19 | ○ | 1 | 20 | 80 | 400 | 9 |
| 13 | Immersion in hot water | 100 | 6 | ○ | 122 | 2 | 20 | 460 | 4 |
| 14 | Immersion in hot water | 75 | 20 | ○ | 22 | 4 | 280 | 460 | 4 |
| 15 | Immersion in hot water | 75 | 26 | ○ | 5 | 9 | 280 | 440 | 6 |
| 16 | Immersion in hot water | 90 | 17 | ○ | 2 | 16 | 210 | 425 | 7 |
| 17 | Immersion in hot water | 80 | 32 | ○ | 1 | 17 | 200 | 425 | 7 |
| 18 | Immersion in hot water | 100 | 14 | ○ | 1 | 13 | 260 | 415 | 8 |
| 19 | Immersion in hot water | 100 | 7 | ○ | 90 | 3 | 270 | 450 | 5 |
| 20 | Immersion in hot water | 70 | 30 | ○ | 5 | 5 | 290 | 470 | 6 |
| 21 | Steam under pressure | * | 4 | ○ | 50 | <1 | 280 | 470 | 3 |
| 22 | Steam under pressure | ** | 2 | x | 20 | <1 | <1 | 455 | 4 |
| 23 | Immersion in hot water | None | | x | 165 | 10 | <1 | 470 | 3 |
| 24 | | 85 | 8 | ○ | 90 | 14 | 260 | 465 | 3 |
| 25 | | 85 | 10 | ○ | 55 | 30 | 180 | 455 | 4 |
| 26 | Immersion in hot water | 95 | 6 | ○ | 125 | 2 | 15 | 460 | 5 |
| 27 | | | 8 | | 110 | 5 | 260 | 455 | 6 |
| 28 | | | 10 | | 24 | 10 | 280 | 445 | 6 |
| 29 | | | 12 | | 3 | 14 | 270 | 415 | 8 |
| 30 | | | 14 | | 1 | 20 | 50 | 410 | 8 |
| 31 | Immersion in hot water | 75 | 23 | ○ | 9 | 18 | 150 | 470 | 3 |
| 32 | Immersion in hot water | 75 | 23 | ○ | 9 | 14 | 260 | 470 | 3 |
| 33 | | | | | | <1 | 280 | 420 | 7 |
| 34 | | | | | | 13 | 260 | 430 | 7 |
| 35 | | | | | | <1 | 290 | 425 | 7 |
| 36 | | | | | | 16 | 200 | 430 | 7 |
| 37 | | | | | | 30 | 100 | 490 | 1 |
| 38 | | | | | | 13 | 280 | 415 | 8 |
| 39 | | | | | | 17 | 240 | 460 | 4 |
| 40 | | | | | | <1 | 400 | 410 | 8 |
| 41 | Immersion in hot water | 70 | 25 | ○ | 7 | <1 | 460 | 350 | 12 |
| 42 | | | | | | <1 | 410 | 390 | 10 |
| 43 | | | | | | 16 | 250 | 425 | 7 |

* at 120° C., 1.4 atm
** at 200° C., 3 atm

What is claimed is:

1. An aluminum or aluminum alloy member having an anodized film formed thereon, wherein the anodized film comprises a porous layer and a non-porous barrier layer between the porous layer and the member;

the non-porous barrier layer has a structure that is at least partly boehmite or pseudo-boehmite; and the anodized film is characterized by that the film dissolving rate measured by the test for immersion in a mixture of phosphoric acid and chromic acid (conforming to JIS H8683-2) is less than 120 mg/dm$^2$/15 min, the ratio of area in which corrosion occurs after standing for 2 hours in an atmosphere of argon containing 5% chlorine (at 300° C.) is less than 15%, and the film hardness (Hv) is no lower than 420.

2. The aluminum alloy member as defined in claim 1, which contains 2.0–3.0 mass % of Mg, less than 0.3 mass % of Si, and less than 0.1 mass % of Cu.

3. The aluminum alloy member as defined in claim 1, which is a vacuum chamber member.

4. A method of making an aluminum or aluminum alloy member, the method comprising anodizing a surface of an aluminum or aluminum alloy member;

hydrating the anodized surface; and producing the member of claim 1.

* * * * *

UNITED STATES PATENT AND TRADEMARK OFFICE

CERTIFICATE OF CORRECTION

PATENT NO. : 7,005,194 B2
DATED : February 28, 2006
INVENTOR(S) : Wada et al.

It is certified that error appears in the above-identified patent and that said Letters Patent is hereby corrected as shown below:

Title page,
Item [73], should read:
-- [73] Assignee: Kabushiki Kaisha Kobe Seiko Sho (Kobe Steel, Ltd.) Kobe (JP) --.

Signed and Sealed this

Twenty-fifth Day of April, 2006

JON W. DUDAS
*Director of the United States Patent and Trademark Office*